United States Patent [19]

Salice

[11] Patent Number: 4,823,436

[45] Date of Patent: Apr. 25, 1989

[54] TWO-PART CONNECTING FIXTURE FOR FURNITURE WHICH INCLUDES A SPRUNG-DETENT LOCKING LEVER

[75] Inventor: Luciano Salice, Carimate, Italy

[73] Assignee: Arturo Salice S.p.A., Novedrate, Italy

[21] Appl. No.: 124,529

[22] Filed: Nov. 24, 1987

[30] Foreign Application Priority Data

Nov. 24, 1986 [DE] Fed. Rep. of Germany ..... 3640012

[51] Int. Cl.[4] ..... E05D 7/12

[52] U.S. Cl. ..... 16/258; 16/382; 16/DIG. 43; 403/327; 403/330

[58] Field of Search ..... 16/236, 237, 238, 239, 16/240, 241, 245, 246, 258, 370, 382, DIG. 43; 403/327, 330

[56] References Cited

U.S. PATENT DOCUMENTS

| | | | |
|---|---|---|---|
| 4,417,366 | 11/1983 | Salice | 16/258 |
| 4,423,537 | 1/1984 | Salice | 16/258 |
| 4,430,771 | 2/1984 | Salice | 16/258 X |
| 4,674,148 | 6/1987 | Salice | 16/382 X |
| 4,701,979 | 10/1987 | Salice | 16/382 X |
| 4,742,599 | 5/1988 | Salice | 16/258 X |

FOREIGN PATENT DOCUMENTS

| | | | |
|---|---|---|---|
| 0145952 | 6/1985 | European Pat. Off. | 16/DIG. 43 |
| 86/02402 | 4/1986 | World Int. Prop. O. | 16/238 |

*Primary Examiner*—Fred A. Silverberg

*Attorney, Agent, or Firm*—Fleit, Jacobson, Cohn & Price

[57] ABSTRACT

In a two-part connecting fixture for connecting parts of a piece of furniture, preferably to a hinge bracket and mounting plate assembly, one of the parts of the fixture is provided with a spring-loaded pivoted lever and the other with an abutment that is interengageable with the lever. The lever and the abutment are respectively provided on confronting surfaces with a beveled or rounded detent flank and with an engaging edge. The lever is arranged to snap to its locking position as the parts are fitted together and are displaced or pivotally moved to a connecting position. The lever is adapted to be released from its locking position by an actuating mechanism. A stop is provided, which during or after the snapping of the lever to its locking position limits the displacement of the parts which are interlocked. A safety mechanism is provided for preventing an unintended release of the interlocked parts. The detent flank is formed with a locking portion consisting of an aperture, recess, notch or step at the beginning of that region of the detent flank which is swept by the engaging edge as the detent lever moves to the locking position. The engaging edge interengages with said locking portion as the detent lever moves toward its release position.

6 Claims, 2 Drawing Sheets

TWO-PART CONNECTING FIXTURE FOR FURNITURE WHICH INCLUDES A SPRUNG-DETENT LOCKING LEVER

BACKGROUND OF THE INVENTION

1. Field of the Invention

This invention relates to a two-part connecting fixture for connecting parts of a piece of furniture, preferably to a hinge bracket and mounting plate assembly, wherein one of the parts of the fixture is provided with a spring-loaded pivoted lever and the other with an abutment that is interengageable with the lever, the lever and the abutment are respectively provided on confronting surfaces with a beveled or rounded detent flank and with a backing edge, the lever is arranged to snap to its locking position as the parts are fitted together and are displaced or pivotally moved to a connecting position, the lever is adapted to be released from its locking position by actuating means, a stop is provided, which during or after the snapping of the lever to its locking position limits the displacement of the parts which are interlocked, and safety means are provided for preventing an unintended release of the interlocked parts.

2. Description of the Prior Art

FIGS. 42 to 50 of European Patent Specification No. 43,903 and corresponding U.S. Pat. No. 4,430,771 show such hinge bracket and mounting plate assemblies. In said assemblies the safety means which prevent an unintended elimination of the detent connection comprise clamping members for blocking the pivoted levers relative to the hinge bracket so that the pivoted levers cannot unintendedly be moved to their release position, in which the detent connection is eliminated. Such movement might occur, e.g., during cleaning work or during the handling of objects. But said known clamping members are additional parts, which add to the cost of the connecting fixture and which require a special adaptation to the hinge bracket and must separately be mounted and must also be separately kept in stock.

SUMMARY OF THE INVENTION

For this reason it is an object of the invention to provide a two-part connecting fixture which is of the kind described first hereinbefore and preferably consists of a hinge bracket and a mounting plate assembly and in which an unintended elimination of the detent connection is prevented without a need for providing additional parts for that purpose.

In a connecting fixture of the kind described first hereinbefore that object is accomplished in accordance with the invention in that the detent flank is formed with a locking portion consisting of an aperture, recess, notch or step at the beginning of that region of the detent flank which is swept by the engaging edge as the detent lever moves to the locking position, and the engaging edge interengages with said locking portion as the detent lever moves toward its release position. In the connecting fixture in accordance with the invention that aperture, recess, step or the like formed in the detent flank constitutes a stop, which will prevent an unintended slipping of the engaging edge from the detent flank if the lever has not arbitrarily been moved as far as to its release position but has unitendedly been moved in a releasing sense. Because an unintended operation of the actuating means for eliminating the detent connection usually does not result in a complete pivotal movement of the detent lever in the outward direction but only in a slight temporary movement of said lever in the releasing sense, the notch or step will constitute effective means for intercepting the engaging edge so that an unintended release of the parts of the connecting fixture will be effectively prevented. One part of the connecting fixture is usually connected to a door or the like and is loaded by the latter so that a release of the connection will be prevented by the weight of the door or the like when the engaging edge has interlocked with the aperture or the like.

The safety device in accordance with the invention can be provided in a simple manner by the formation of an aperture, recess or step in the detent flank so that there is no need for additional parts or for an additional structure, which would add to the manufacturing costs.

The detent flank may be constituted by the abutment and may be disposed adjacent to the locking portion of the pivoted lever and may be spiral-shaped or eccentric with respect to the pivotal axis of said lever in such a manner that the lever will bear on the detent flank so as to force the parts against each other without a backlash.

The detent flank may alternatively be provided on the lever and may be spiral-shaped or eccentric with respect to the pivotal axis of the lever in such a manner that the lever will bear on the abutment so as to force the parts against each other without a backlash.

The invention may also be applied to connecting fixtures in which the detent flanks are approximately concentric to the pivotal axis of the lever and have no self-stressing action.

DETAILED DESCRIPTION OF THE PREFERRED EMBODIMENTS

Figure 1:
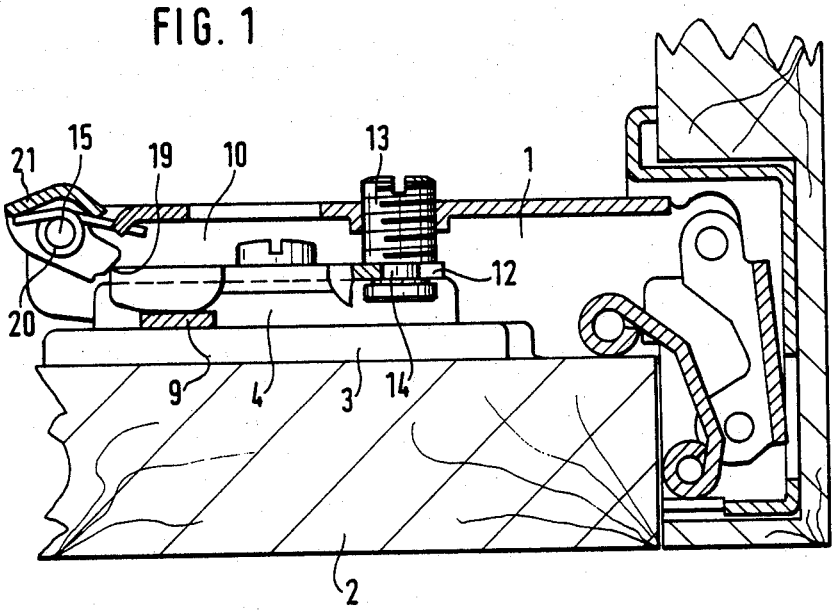
FIG. 1 is a longitudinal sectional view showing a hinge bracket which is locked to a mounting plate.
Figure 2:
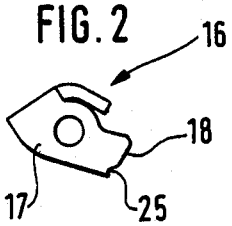
FIG. 2 is a side elevation showing the detent lever of FIG. 1.
Figure 3:
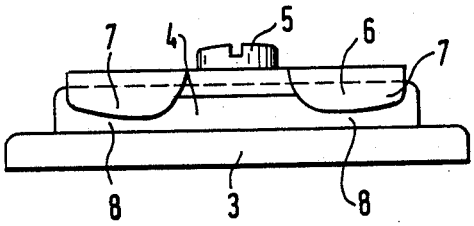
FIG. 3 is a side elevation showing the mounting plate of FIG. 1, which plate consists of a base plate and a cover plate.
Figure 4:
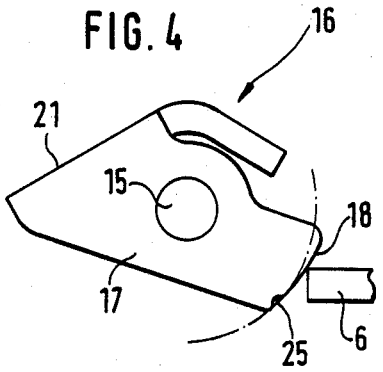
FIGS. 4 and 5 are enlarged side elevations showing the detent lever of FIG. 1 in a locking position and in an intercepted position, respectively.

Illustrative embodiments of the invention will now be explained more in detail with reference to the drawing.

For the fixation of a substantially channel-shaped hinge bracket 1, a base plate 3 is secured in the usual manner to a carrying wall 2, which consists of a wall of a cupboard or of another corpus part. The base plate 3 is provided with fixing bores in its intermediate portion is provided with a mounting structure 4, to which a cover plate 6 is secured by the fixing screw 5. The cover plate 6 consists of a die-cut sheet metal element, which is formed with lugs 7, which have been bent off to provide a channel section. The lower edges of the leglike lugs 7 terminate above the lateral portions of the base plate 3 at such a distance therefrom that guiding grooves 8 are provided on both sides of the mounting structure 4. Said guiding grooves serve to guide ribs 9, which are angled inwardly from opposed downwardly extending limbs 10 of the hinge bracket 1.

The mounting structure 4 is U-shaped in top plan view.

The cover plate 6 is formed on both sides of its intermediate web portion with open slots 12. A fixing and adjusting screw 13 is screwed into the top web portion of the hinge bracket 1 and has an annular groove 14, which can be pushed into a slot 12 of the cover plate 6. The hinge bracket 1 can be pushed onto the mounting structure which consists of the base plate 3 and the cover plate 6, from the right in FIG. 1, to assume the position shown in FIG. 1, in which the bottom of annular groove 14 engages the cover plate 6 at the inner end of the slot 12.

The detent lever 16 is pivoted on a pivot pin 15 to the rear end portion of the hinge bracket 1 between its limbs 10. The detent lever 16 consists of a die-cut sheet metal element, which comprises an intermediate web portion and legs 17, which are angled from the sides of said web portion. As the hinge bracket 1 is pushed onto the mounting structure, the detent lever will slide over the top of plate 6 and snap into engagement behind edge 19 of the plate to prevent removal of the bracket. The legs 17 constitute a double lever and, at their inner edges, are provided with detent flanks 18, which will bear on the rear engaging edge 19 of the cover plate 6 when the hinge bracket 1 is interlocked with the mounting plate 3, 6 in the position shown in FIG. 1.

A helical spring 20 is held on the pivot pin 15 and has legs which respectively bear on the web portion of the hinge bracket and on the web portion of the detent lever 16, which constitutes a releasing key 21.

The detent flank 18 is spiral-shaped or is eccentrically curved with respect to the center line of the pivot pin 15 so that the detent lever 16 will force the hinge bracket 1 against the mounting plate without backlash. To release the hinge bracket downward pressure is applied to key 21 so as to free the detent lever and allow the bracket to be pushed to the right.

The hinge bracket and mounting plate assembly described hereinbefore corresponds to the hinge bracket and mounting plate assembly shown in FIGS. 7 to 11 of the European Patent Publication No. 145,952 corresponding to U.S. Pat. No. 4,674,148, the disclosure of which is incorporated herein by reference for further explanation.

Figure 5:
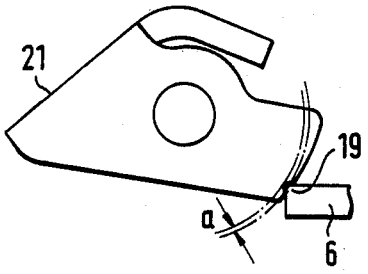

The detent flanks 18 are formed in their forward portions with notches or step-shaped recesses 25, which will receive the engaging edge 19 of the cover plate 6 in the position shown in FIG. 5 before the detent flanks 18 can disengage the engaging edge to eliminate the detent connection when releasing the bracket. As the notch or recess 25 has a depth a, the detent connection which is in the position shown in FIG. 5 cannot be eliminated until the hinge bracket 1 has been forced back by the distance a and the releasing key 21 has subsequently been actuated.

Figure 6:
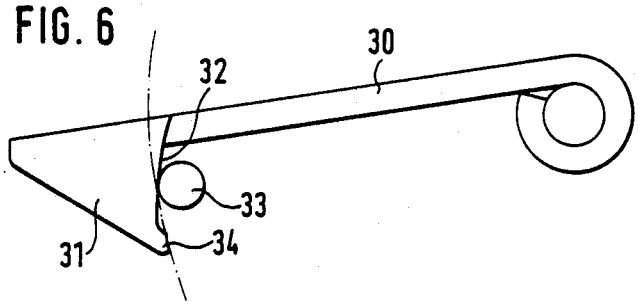
FIG. 6 is a diagrammatic view showing a detent connection consisting of a detent lever and a pinlike abutment.

In the embodiment shown in FIG. 6, the detent connection is constituted by the detent lever 30, which has a hook-shaped end portion 31 that is formed with detent flanks 32, which interlock with an abutment pin 33. A similar detent connection is known, e.g., from FIGS. 42 to 50 of European Patent Specification No. 43,903 and U.S. Pat. No. 4,430,771.

Means for preventing an unintended separation are constituted by projecting steps 34 provided at the ends of the detent flanks 32.

Figure 7:
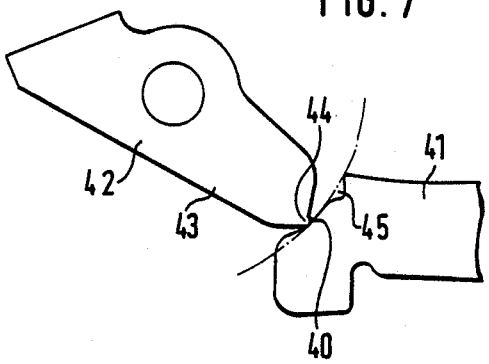
FIG. 7 is an enlarged side elevation showing a detent lever which bears on a curved detent flank of the mounting plate.

In the illustrative embodiment shown in FIG. 7, the detent flanks 40 are provided on the angled rear legs of a cover plate 41, which is screw-connected to a base plate. The double-armed lever 42 is pivoted to a hinge bracket and has a lever arm 43 which by a spring, not shown, is biased toward the detent flanks 40. The lever arm 43 is provided with an engaging edge 44, which bears on the detent flanks 40 in frictional contact therewith. To that extent the illustrated detent device corresponds to the detent device of the hinge bracket and mounting plate assembly shown in FIGS. 1 to 6 of European Patent Publication No. 145,952 and U.S. Pat. No. 4,674,148, which is incorporated herein by reference as far as details are concerned.

Each detent flank 40 is formed in its upper portion with a notch 45, which will receive and retain the engaging edge 44 when the detent lever 42 has unintendedly been moved in the releasing sense.

I claim:

1. A two-part connecting fixture for connecting parts of a piece of furniture, preferably to a hinge bracket and mounting plate assembly, wherein one of the parts of the fixture is provided with a spring-loaded pivoted lever and the other with an abutment that is interengageable with the lever, the lever and the abutment are respectively provided on confronting surfaces with a curved detent flank and with an engaging edge facing the detent flank, the lever is arranged to move about a pivot axis and snap to a locking position as the parts are fitted together, actuating means is provided for moving the lever from its locking position to a release position in which the lever is free of the abutment, a stop is provided, for limiting the displacement of the parts which are interlocked, and the fixture includes interengaging means on the detent flank and the engaging edge respectively for arresting the lever as it is moved from the locking position toward the release position and preventing separation of the parts except by movement of the pivot axis of the lever.

2. A connecting fixture according to claim 1, characterized in that the detent flank is constituted by the abutment and is eccentric with respect to the pivotal axis of said lever in such a manner that the lever will bear on the detent flank so as to force the parts against each other without a backlash.

3. A connecting fixture according to claim 1, characterized in that the detent flank is provided on the lever and is eccentric with respect to the pivotal axis of the lever in such a manner that the lever will bear on the abutment so as to force the parts against each other without a backlash.

4. A connecting fixture according to claim 1, characterized in that the detent flank is approximately concentric to the pivotal axis of the lever.

5. A connecting fixture according to claim 1 wherein the interengaging means includes a recess in the detent flank into which the engagement edge is adapted to fit.

6. A connecting fixture according to claim 1 wherein the interengaging means includes a projection on the detent flank against which the engagement edge is adapted to fit.

* * * * *